US011087940B2

(12) United States Patent
Falkingham

(10) Patent No.: US 11,087,940 B2
(45) Date of Patent: Aug. 10, 2021

(54) ELECTRICAL INTERRUPTION DEVICE

(71) Applicant: VACUUM INTERRUPTERS LIMITED, Rugby (GB)

(72) Inventor: Leslie Falkingham, Rugby (GB)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 16/341,989

(22) PCT Filed: Dec. 14, 2017

(86) PCT No.: PCT/GB2017/053752
§ 371 (c)(1),
(2) Date: Apr. 15, 2019

(87) PCT Pub. No.: WO2018/069738
PCT Pub. Date: Apr. 19, 2018

(65) Prior Publication Data

US 2019/0252139 A1 Aug. 15, 2019

(30) Foreign Application Priority Data

Oct. 14, 2016 (GB) ..... 1617458

(51) Int. Cl.
*H01H 9/38* (2006.01)
*H01H 33/08* (2006.01)
(Continued)

(52) U.S. Cl.
CPC ..... *H01H 33/664* (2013.01); *H01H 33/12* (2013.01); *H01H 9/38* (2013.01); *H01H 33/08* (2013.01); *H01H 33/20* (2013.01)

(58) Field of Classification Search
CPC ..... H01H 33/664; H01H 33/12; H01H 33/20; H01H 33/6646; H01H 9/30; H01H 9/38;
(Continued)

(56) References Cited

U.S. PATENT DOCUMENTS 3,014,109 A * 12/1961 Burger ..... H01H 33/6646 218/126
3,210,505 A * 10/1965 Porter ..... H01H 33/12 218/118
(Continued)

FOREIGN PATENT DOCUMENTS

EP 1039495 A2 9/2000
EP 2434513 A1 3/2012

OTHER PUBLICATIONS

Translation of EP1039495 (original document published Sep. 27, 2000) (Year: 2000).*
(Continued)

*Primary Examiner* — William A Bolton

(57) ABSTRACT

An electrical interrupter device for switching a short-circuit electrical current in an electric circuit is disclosed. The device comprises a vacuum evacuated housing (58); first and second electrodes (54, 56) at least partially located within the housing. The first and second electrodes (54, 56) are separated by a rail gap. A third electrode (52) moveable relative to the first and second electrodes (54, 56) between a closed circuit position and an open circuit position is provided, whereby an electrical arc is generated between the third electrode (52) and at least one of the first and second electrodes (54, 56) during said movement. Once generated, the arc is directed by the first and second electrodes (54, 56) away from the third electrode (52).

18 Claims, 7 Drawing Sheets

(51) Int. Cl.
*H01H 33/12* (2006.01)
*H01H 33/20* (2006.01)
*H01H 33/664* (2006.01)

(58) Field of Classification Search
CPC ..... H01H 33/08; H01H 2033/6623; H01H 2033/6668; H01H 31/003
USPC ..... 218/32, 40, 42, 126, 127, 140, 146; 313/141, 383, 390, 449, 459, 495
See application file for complete search history.

(56) References Cited

U.S. PATENT DOCUMENTS 3,372,259 A * 3/1968 Porter ..... H01H 33/6645 218/129
3,405,245 A * 10/1968 Ito ..... H01H 33/6647 218/126
3,575,564 A * 4/1971 Weston ..... H01H 33/6647 218/123
3,953,693 A 4/1976 Pflanz
4,041,126 A 8/1977 Rich
4,128,748 A * 12/1978 Lafferty ..... H01H 33/6646 200/262
6,211,479 B1 * 4/2001 Ohara ..... H01H 33/004 218/146
2013/0220977 A1 * 8/2013 Gentsch ..... H01H 33/12 218/123
2016/0126035 A1 5/2016 Turbomeca

OTHER PUBLICATIONS

The Written Opinion and the International Search Report for International Application No. PCT/GB2017/053752 dated Apr. 5, 2018. (15 pages).

* cited by examiner

Prior Arts

ELECTRICAL INTERRUPTION DEVICE

The present disclosure relates to an electrical interruption device. In particular, it relates to a vacuum evacuated electrical interruption device for switching a short-circuit electrical current in an electric circuit.

BACKGROUND

Electrical interruption or switching devices are utilized in medium voltage electrical installations. The most widely used incorporate a vacuum switching device typically referred to as a vacuum interrupter. Vacuum switching devices are typically employed as part of switchgear, which is a broad term for the combination of electrical components used to control, protect and isolate electrical equipment and circuits. Switchgear generally comprise a switching device, such as a vacuum interrupter, an actuator for exerting and applying a force to switch the switching device, and a detection system for detecting a switching requirement (including faults) in the electrical equipment/circuit.

Vacuum interrupters are well known for switching high currents in the transmission and distribution of electricity. In known vacuum interrupters a pair of electrodes or contacts is enclosed within an insulating vacuum container as shown in simplified form in FIG. 1. One contact (10) is fixed in position and the other (11) can be moved by an external actuator to separate the contacts and cause making or breaking of the current to occur. The movement of this contact through the wall of the vacuum chamber (12) is usually enabled by a bellows (13). The contacts are made mainly of a high conductivity material, usually copper, but the contact faces (14) are made of special material, such as a copper-chrome alloy. Not shown are metal shields which prevent metal vaporized by arcing from depositing on the inside of insulating parts of the vacuum container.

When the contacts separate an electric arc is drawn in the vacuum and this arc must be controlled to prevent damage to the contact surfaces during the time before the arc becomes extinguished. Arc control is usually achieved by a magnetic field, which is created by causing the current being switched to travel in circular paths on its way to the contact faces. There are two forms of arc control in general use: axial and radial magnetic field arc control.

Contacts for axial magnetic field arc control are illustrated in FIG. 2 which is a cross-section of a contact assembly. The contact stem (21) bringing current to each contact face is formed into a cup shape (22) below the contact face, and angled slots (23) are cut into the side of the cup, causing the current to flow in a spiral path towards the edges of the contact face, from where it spreads onto the contact face. This form of current flow generates a magnetic field which is generally in the direction of the axis of the assembly. The second contact has its slots in the same sense as the first, and the magnetic fields of the two contacts combine to form a magnetic field which is generally in the axial direction over the whole area of the contact faces. Now at high currents the arc tends to constrict, such that the arc does not spread evenly over the face of the contact but concentrates normally at a single spot on the surface. Concentrated current at this spot causes melting and erosion of the contacts and must be avoided. The effect of the axial magnetic field is to cause the arc to diffuse more evenly over the contact surface.

One form of contacts for radial magnetic field arc control are illustrated in FIG. 3. In this case the structure is similar except that the slots in the second contact are cut in the opposite sense to those in the first contact. The effect of this is that the currents cooperate to produce a radial field at the edges of the contact surfaces. The motor effect then operates, whereby arc current at the edges of the contacts is caused to move along a circumferential path. The arc constriction still occurs, but because the arc is caused to keep moving, damage to the contact surface is avoided. the central area is not required, and the contact faces (31) are made in the form of a ring.

The known designs of vacuum interrupter have some disadvantages which are now explained.

The contacts previously described have higher electrical resistance than plain rods of copper making butt contact would have because of the longer path lengths taken by the current and the higher resistance of the special contact material. This means that when normal load current is flowing continuously through closed contacts there is more heating in the contact area. This tends to heat the whole device, which lowers the maximum possible load current that the device can carry. There is also waste of power.

The contact assembly in known vacuum interrupters is expensive to manufacture because of the number of parts to be made and assembled, and the use of special materials for the contact surfaces.

The known type of vacuum interrupter is intrinsically cylindrical, which means that the ceramic insulator must be made as an extrusion, which is an expensive process. If the interrupter could have a box-shaped vacuum envelope, the ceramic parts could be made a pressing, which is a much cheaper process.

A further issue with conventional vacuum interrupters is that they are primarily almost exclusively intended for use with alternating current (AC) electrical sources, rather than direct current (DC) electrical sources. A primary reason for this limitation of vacuum interrupters is the requirement of a natural current zero required to extinguish any generated arc. Naturally, for AC sources, a current zero occurs every 0.1 second with a 50 Hz source, so that the length of time that an electrical arc can exist is limited. However, with a DC source there is no natural current zero and so the arc does not extinguish and can continue indefinitely.

Some attempts have been made to overcome this limitation, but these primarily involve generating an artificial current zero, such as in US2017263399, or by utilizing an additional surge arrester and resonance circuit to oppose the DC current as in WO2012/045360 or by utilizing additional electronics. However, modifications to the structure and shape of the contact electrodes themselves have not generally been considered. In particular, the concept of directing or transferring the generated arc in vacuum, away from the contacts or electrodes does not appear to have been seriously considered previously.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
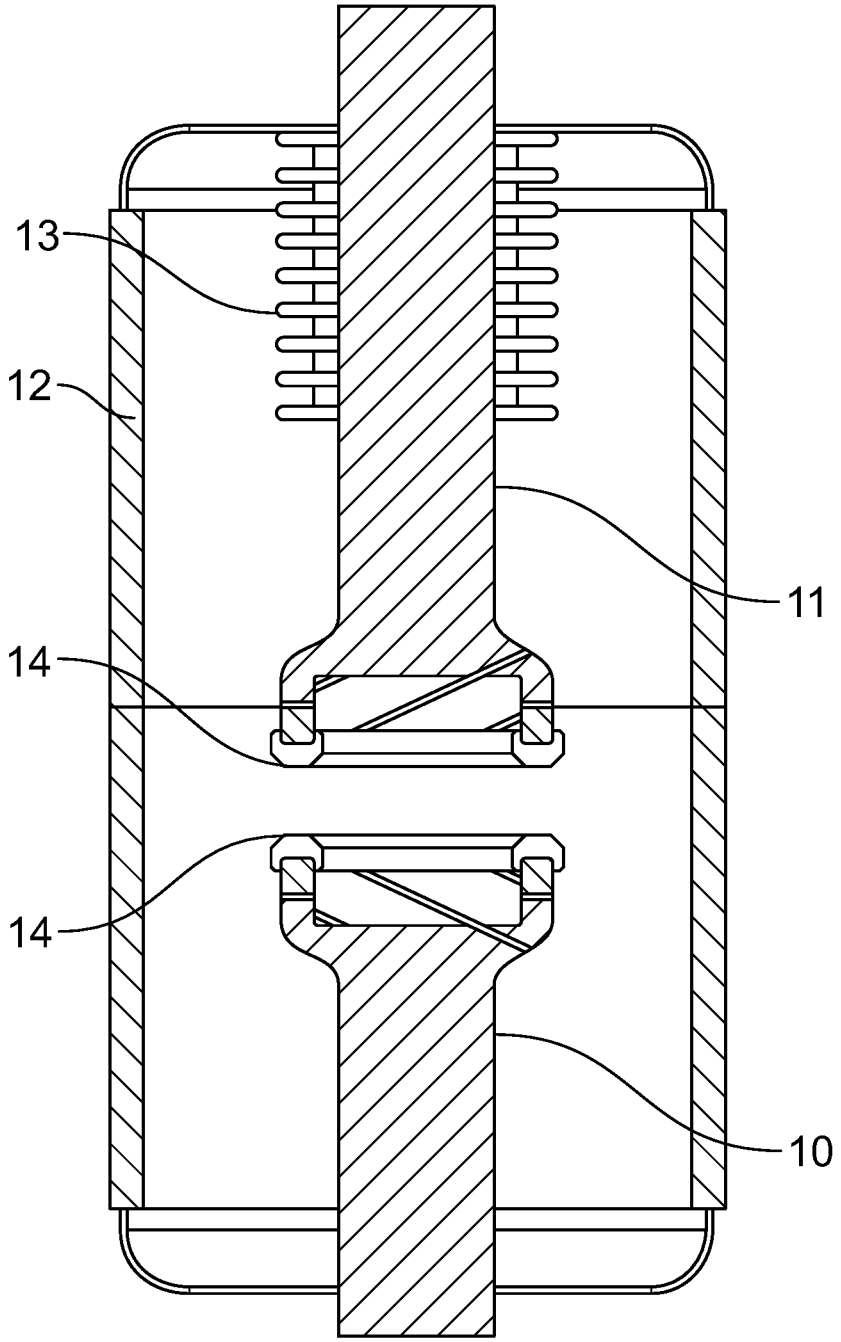
FIG. 1 Prior Art
FIG. 1 is a prior art vacuum interrupter.

According to a first aspect of the herein described embodiments, there is provided an electrical interrupter device for switching a short-circuit electrical current in an electric circuit, said device comprising: a vacuum evacuated housing; first and second electrodes at least partially located within the housing, said first and second electrodes separated by a rail gap; a third electrode moveable relative to the first and second electrodes between a closed circuit position and an open circuit position, whereby an electrical arc is generated between the third electrode and at least one of the first and second electrode during said movement; wherein the arc is directed by the first and second electrodes away from the third electrode.

This arrangement significantly reduces the wear and requirements of the contact faces of the electrodes between which an electrical arc is typically generated. By utilizing the above described arrangement, the generated arc is directed away from the point at which the arc is generated. This helps the arc to dissipate and allows non-circular electrodes to be utilized.

In an embodiment the first and second electrodes may be non-circular. This allows the device to be designed and configured to fit within non-standard spaces that are not typically suited to vacuum interrupter devices.

In another example, the device further comprises a fourth electrode, moveable relative to the third electrode to create the short circuit and the open circuit positions. The fourth electrode may be opposing said third electrode, wherein the third electrode is moveable relative to the fourth electrode and wherein the third and fourth electrodes are in contact in the closed-circuit position and are separated by an arc gap in the open circuit position.

In this instance, the arc may be initially generated between the third and fourth electrodes before transferring to between the third and at least one of the first and second electrodes. This allows the surfaces of the electrodes to be tailored for their intended purpose. In other words, the third and fourth electrodes can be coated or adapted to maximize the durability or tailored for arc formation, whilst the first and second electrodes are tailored for directing the arc away from the third electrode. It may be appreciated that the arc will transfer when the gap between the third and fourth electrode is greater than the gap between the third and either the first or second electrode.

In such embodiments, the third electrode may be moveable relative to the fourth electrode and the third and fourth electrodes are in contact in the closed-circuit position and are separated by an arc gap in the open circuit position. Movement of the third electrode relative to the fourth electrode may generate the electrical arc in the arc gap. The arc may be transferred from the arc gap to the rail gap when the third electrode moves a distance further away from the fourth electrode than the distance of the rail gap.

According to a further embodiment two electrodes are provided in the form of two generally parallel bars of fixed length, which may be considered to be rails, such that current can enter substantially at one end of one bar, travel for a distance along the bar, cross by means of an arc to the other bar and then travel back and leave at the same end that it entered.

An arc struck between the bars may move away along the pair of bars until it extinguishes. This movement of the arc is caused by magnetic field from the current flowing along one bar and back along the other, exerting force on the current in the arc.

The bars may be sufficiently long for a current zero to occur before the arc reaches the ends of the rails, or else the rails may lead to a means to extinguish the arc. The physics is similar to that employed in rail guns. It can be appreciated that rail guns are not housed within vacuum and are not used as electrical interrupter devices. By utilizing this rail effect, the arc may be directed away from the initial location in a manner akin to a railgun. Optionally or preferably the rails are substantially linear.

Linear switching electrodes may combine easily with electrodes for continuous current so that transfer switching can be achieved in a vacuum interrupter.

Thus, there is provided an electrical interrupter device for switching an electrical current load in an electric circuit, said device comprising: a vacuum evacuated housing; first and second linear electrodes at least partially located goes through wall of the housing; and means for allowing one electrode to move and to be connected to an actuator while remaining electrically connected to the external circuit.

By utilizing a non-circular geometry for at least one of the first and second electrodes, the arc generated during an interruption event may be directed away from where the arc was generated. This allows the design of the interruption function to be separated from the design of the continuous current function, allowing both to be optimized. For example, by directing the arc away from the continuous current electrode points of the electrodes the continuous current electrode faces may be formed of a material more suited for continuous current flow (such as copper) rather than having to be optimized for arc dissipation as is currently the case for standard electrical interrupters. Also, this removes the increased resistance incurred by forcing the current into extended circular paths when conducting the continuous current.

Preferably, both the first and second electrodes are non-circular and act as electrical rails to direct the arc.

By utilizing this rail effect, the arc may be directed away from the electrical switching location in a manner akin to a railgun. Optionally or preferably the rails are substantially linear. Linear switching electrodes can combine easily with electrodes for continuous current so that transfer switching can be achieved in a vacuum interrupter.

In embodiments the rails are substantially parallel. This aids the effect of directing the arc due to current in the rails. By moving away from standard circular geometry for the electrodes, the design of the interrupter device may be optimized for the required or allowed space provided by the electrical circuit. For example, a flat interrupter may be designed using parallel rails that direct an arc to an arc quenching point or device.

In embodiments the rails are divergent. This allows the arc to be expanded as it travels along the rails, weakening the electrical field strength and increasing the arc voltage, which aids dissipation of the arc.

In other embodiments at least, a portion of the rails are trumpeted. As noted above, for either divergent or parallel rails, a portion of the rails may be trumpeted. This allows the arc to be expanded as noted above.

For non-parallel rails the actuator may separate the electrodes in a scissor action. In such embodiments, the third electrode may be integrated with either the first and second electrode, such that when the third electrode moves the first and second electrodes separate in a scissor action. For example, the first electrode and the second electrode may be in electrical contact at one end of each electrode before separation.

In an embodiment the first electrode may be substantially tubular, and the second electrode may be a rod that sits within the first electrode. The first electrode may be substantially spiraled or curved. In other embodiments, the first and/or second electrode may be considered to be 3D shapes, such as spirals, snakes, helixes or the like.

In embodiments the first and second electrodes may be helically aligned.

In other types of circuit breakers, such as gas-insulated circuit breakers the problem of resistance can be overcome by using two concentric pairs of electrodes. One pair of electrodes is of simple plain rod design and carries the continuous load current when the circuit breaker is closed. When current needs to be switched it is transferred to a second pair of more specialized electrodes which are normally coaxial with first pair, interrupt the current. This is called transfer switching. The principle of operation of gas circuit breakers is quite different to that of vacuum interrupters and lends itself to this approach. For this reason, gas-insulated interrupters can conduct higher continuous currents than vacuum interrupters.

Structures in accordance with the herein described embodiments provide a way to apply transfer switching in vacuum interrupters and so achieve higher continuous current ratings than previously possible with vacuum interrupters. It also separates the design of the interruption function from that of the continuous current function, allowing both to be optimized, and also allows vacuum interrupter designers to move away from the universal cylindrical shape of vacuum interrupters to date.

Now in conventional vacuum interrupters the electrodes for radial magnetic field are circular in shape and arcs are able in principle to travel continuously around the circumference although in practice they may extinguish at a current zero before making more than a partial circuit.

In embodiments the arc may be directed towards an arc quenching means. The arc quenching means may comprise an arc baffle plate target, and wherein the arc is directed to the target for dissipation.

Furthermore or alternatively, the arc quenching means may comprise arc splitter plates. The arc splitter plates may comprise a plurality of substantially parallel quenching plates; said quenching plates intended to divide the arc into a corresponding plurality of smaller arcs, each smaller arc driven between two quenching plates.

The electrodes may comprise one or more slots, each slot can be oriented to produce a magnetic field across the electrodes. The magnetic field may act to drive the arc along the electrodes.

The electrical current load may be a direct current load. This is particularly unusual and considered unique if the interrupter device is a vacuum interrupter. Previously, in order to extinguish the electrical arc generated by the interrupter device, the circuit relies on the arc automatically dissipating at the next zero-point current. Naturally, for alternating current circuits zero-point current occurs roughly every 10 ms for 50 Hz sources and every 8.33 ms for 60 Hz sources. Direct current sources do not have zero-point currents and so have traditionally been unable to use vacuum interrupters.

However, in accordance with the herein described embodiments, the interrupter diverts the arc away from the arc generation point allowing it to be extinguished away from the electrodes by increasing the arc voltage significantly. This allows the device to be used for direct current sources.

According to another aspect of the herein described embodiments there is provided a non-cylindrical vacuum interrupter form. By utilizing a non-circular electrode geometry the design of the interrupter may be non-circular and optimized according to spatial or electrical requirements.

In this aspect, the current interruption function need not be performed by a pair of circular electrodes but by electrodes of a different geometry. Interruption can be performed for example by a pair of linear electrodes, and this has the advantage that the interrupter can be made in a flat form, so that, for example, a set of three can fit more conveniently into switchgear.

In particular, the vacuum interrupter may include a vacuum evacuated housing; first and second electrodes at least partially located within the housing, said first and second electrodes relatively fixed in position; and a third electrode moveable relative to the first and second electrodes between a short circuit position and an open circuit position, whereby an electrical arc is generated between the third electrode and at least one of the first and second electrodes during said movement; and wherein the arc is directed by the first and second electrodes away from the third electrode.

In another example, the vacuum interrupter further includes a fourth electrode, moveable relative to the third electrode to create the short circuit and the open circuit positions. In this instance, the arc is initially generated between the third and fourth electrodes before transferring to between the third and at least one of the first and second electrodes. This allows the surfaces of the electrodes to be tailored for their intended purpose. In other words, the third and fourth electrodes can be coated or adapted to maximize the durability or tailored for arc formation, whilst the first and second electrodes are tailored for directing the arc away from the third electrode. It may be appreciated that the arc will transfer when the gap between the third and fourth electrode is greater than the gap between the third and either the first or second electrode.

In such embodiments, the third electrode may be moveable relative to the fourth electrode and the third and fourth electrodes are in contact in the closed-circuit position and are separated by an arc gap in the open circuit position. Movement of the third electrode relative to the fourth electrode may generate the electrical arc in the arc gap. The arc may be transferred from the arc gap to the rail gap when the third electrode moves a distance further away from the fourth electrode than the distance of the rail gap.

In any embodiment, the first and second electrodes may be fixed in position within the housing.

According to another herein described embodiment there is provided an electrical interrupter device for switching an electrical current load in an electric circuit, said device comprising: a vacuum evacuated housing; first, second, and third, electrodes at least partially located within the housing; and an actuator for separating the first electrode relative to the second electrode, whereby an electrical arc is generated between these electrodes after separation; wherein the second and third electrodes are non-circular, such that the electrical arc is transferred from the first electrode to the third electrode and directed along these non-circular electrodes.

According to a further aspect, there is provided a vacuum interrupter for interrupting a direct current by directing an electrical arc formed between separated electrical electrodes away from said electrodes.

In a preferred embodiment the electrical electrodes are non-circular.

In may be appreciated that a vacuum interrupter may comprise the electrical interrupter device according any part of the first aspect, whereby an electrical current load is a direct current load and the electrical electrodes are the electrodes.

Figure 4:
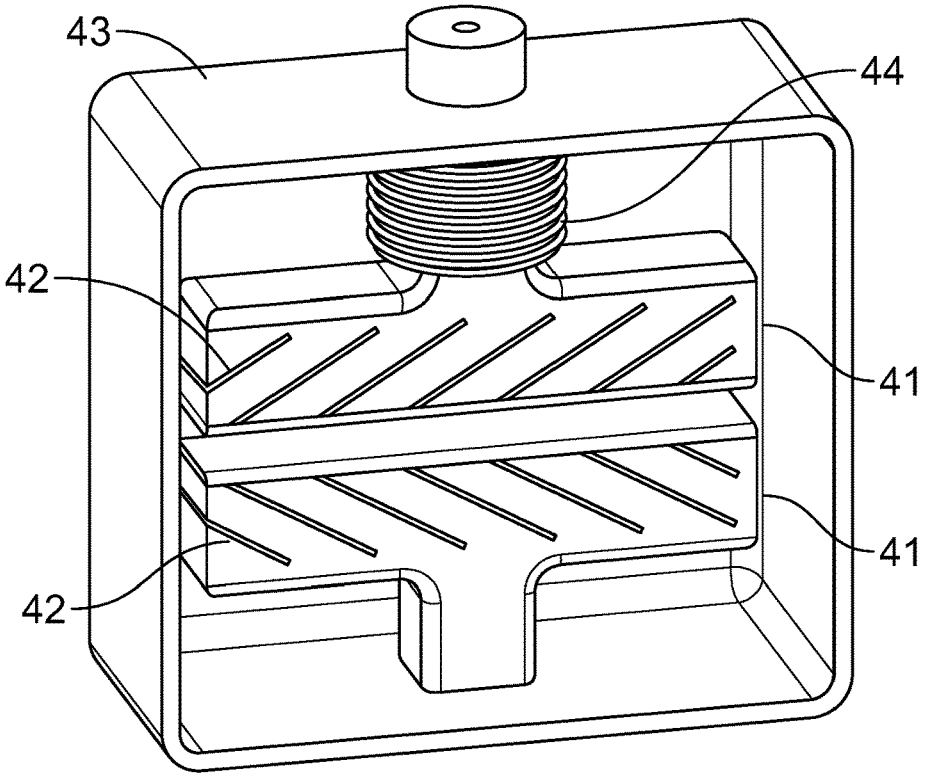
FIG. 4 is an illustration of a linear vacuum interrupter according to the present invention.

FIG. 4 illustrates a simple linear interrupter in partial section view, said interrupter comprising contacts 41 enclosed within a housing 43. The housing is generally vacuum evacuated and is sometimes referred to as an envelope. The vacuum interrupter comprises electrodes or contacts 41 which have slots 42 oriented to produce magnetic field across the width of the contacts, so that when an electrical current is passed through the contacts and the contacts separated an arc is formed. The electrical contacts 41 thus are designed to engage and disengage mechanically to perform a switching function. Normally this movement is permitted without breaking the seal of the evacuated envelope 43 by means of a bellows or diaphragm arrangement 44. In the example shown the arc is moved by the motor effect along the length of the contacts. The length is chosen to be sufficient to control the arc until it extinguishes. This may be called a transverse field linear contact and is to some extent equivalent to a radial field circular contact. The contacts 41 are enclosed within an insulating vacuum enclosure 43. This may for example be in the form of an insulating container of lunch box shape 43, sealed shut on one side by a generally rectangular lid (not shown). Shields which prevent deposition of metal vapor are also not shown. The moveable contact passes through the vacuum enclosure via a bellows 44.

A simple linear interrupter whose contacts produce field perpendicular to the contact faces requires the two current paths to be offset to either side of the active contact face and is equivalent to an axial field circular contact.

Figure 5:
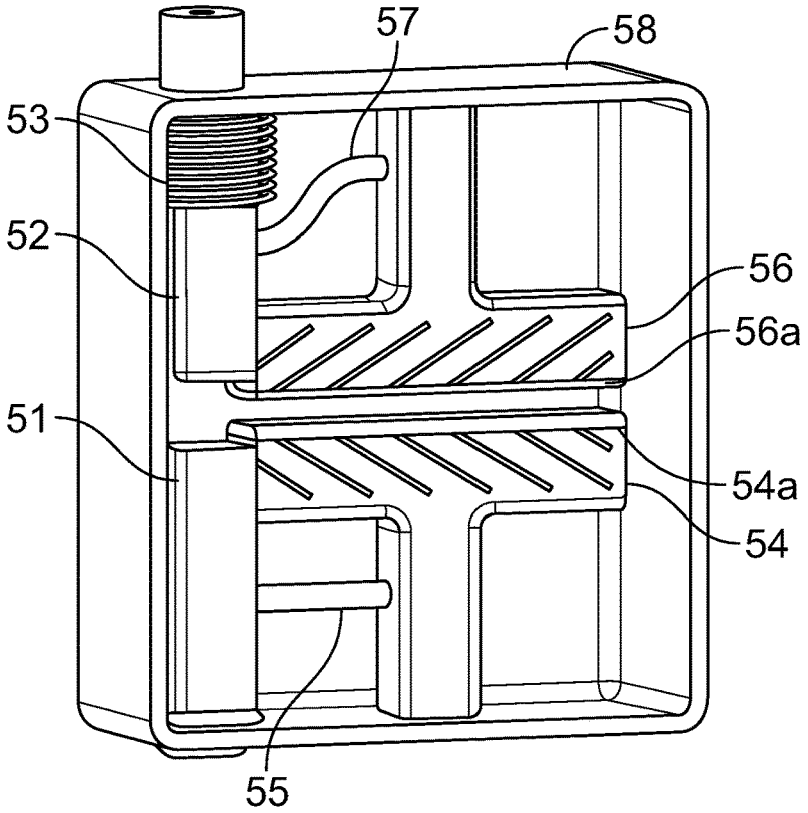
FIG. 5 is an illustration of an alternative linear vacuum interrupter according to the present invention with electrical contacts equivalent to the radial electrical contacts of FIG. 3.

FIG. 5 illustrates a linear transfer switching interrupter whose contacts are equivalent to radial field circular contacts. The continuous current contacts are on the left and consist of a fixed contact 51 and a moving contact 52 which passes through bellows 53. These contacts are shown in the open position in FIG. 5.

As in FIG. 4, the interrupter is housed within a vacuum evacuated enclosure 58 and operates broadly similar to the embodiment described above in FIG. 4. However, in this example, to make a current the contacts 51 and 52 are closed, arcing not being a problem during current make. These contacts remain closed during passage of normal current.

Adjacent to these contacts 51, 52 is one end of a pair of linear contacts 54, 56 having arc surfaces 54*a*, 56*a*. These linear contacts 54, 56 are of fixed contact gap (i.e. they are separated by a constant distance), and do not require a bellows because they are contained within the vacuum housing 58 and do not move relative to the housing 58. The lower linear contact 54 is connected by a rigid conductor 55 to the fixed continuous contact 51 and the upper linear contact 56 is connected by a flexible connector 57 to the moving continuous contact 52. The switching contacts 51, 52 are slotted in opposite directions as shown, and when current flows magnetic field in the contact gap is in a direction across the contact faces, i.e. perpendicular to the plane of the diagram.

When current break is required force is applied to the moving continuous contact 52 and as it separates from its fixed contact 51 an arc is formed between their faces. As soon as the gap, referred to as an arc gap, between these faces is wider than the gap, referred to as a rail gap, between the linear switching contacts 54, 56, the arc transfers to that gap, and the current path transfers via the rigid conductor 55 to the stem of the lower switching contact, and via the flexible contact to the stem of the upper switching contact. Because of the magnetic field produced by the current in the slots and the contact rail, the arc moves along the length of the linear contacts gap, preventing damage to the contact surfaces and facilitating current interruption.

This assembly also fits in a vacuum container which may be in the form of a lunch-box shaped ceramic with a lid which can be sealed in place.

In a variant form of the transverse field linear interrupter the slots reverse direction half way along each contact, so that the arc can oscillate back and forth along the length of the contacts.

In a variant form of the transverse field linear interrupter there are no slots, and instead the force on the arc is provided by the flow of current along the rails feeding the arc.

The geometry of a linear contact vacuum interrupter and the small depth which its vacuum container can have, make it feasible to produce the magnetic fields required with magnets placed against the outside the vacuum container. Current carrying coils may also be used, which would need to be energized only during the moments of current breaking. This arrangement can allow the bellows to be removed such that actuation of the moving contact 52 is actuated either from within the vacuum chamber or externally through the walls of the chamber.

Figure 6A:
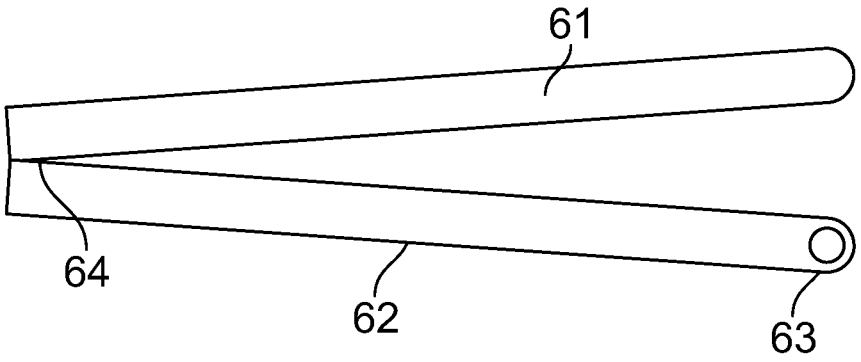
FIGS. 6*a*-6*c* are illustrations of a pair of electrical contacts when closed (a), initially opened (b) and a fixed time later (c)
Figure 6B:
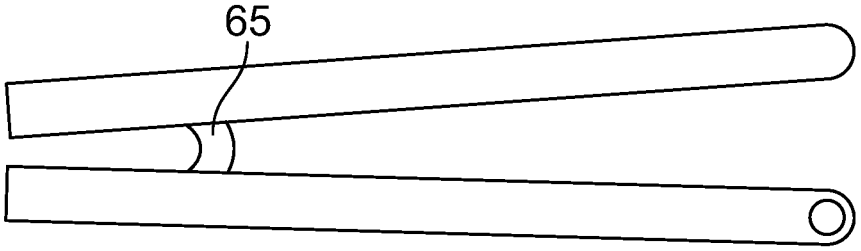
Figure 6C:
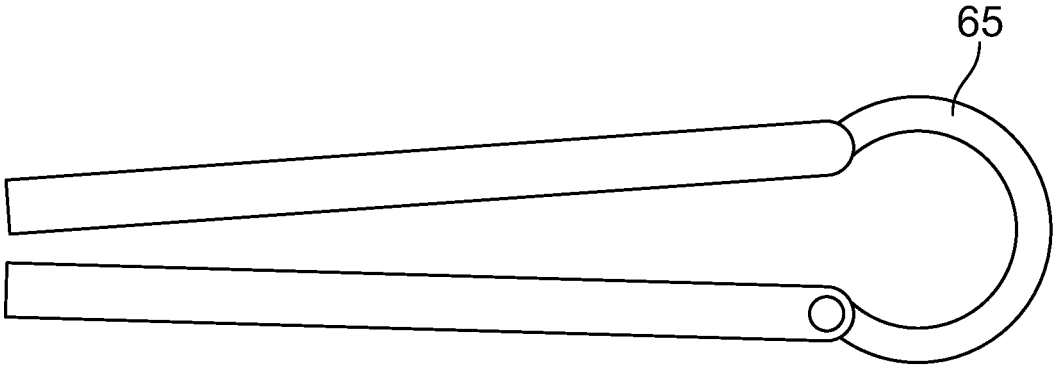

FIGS. 6*a*-6*c* show alternative configurations for the electrodes or contacts within a vacuum interrupter. The embodiment of FIG. 6 essentially combines the switching contacts 51, 52 and the linear contacts 54, 56 of FIG. 5. FIG. 6*a* shows a fixed contact 61 and a moveable contact 62. The contacts 61, 62 are shown as elongate rods or bars rather than conventional circular contact plates.

Movement of the moveable contact 62 may be by an actuator, such as a permanent magnet actuator or other known mechanism. In the example shown the moveable contact pivots about a fixed point and may be actuated to pivot downward away from fixed contact 61. However, the principle of having the moveable contact move away from the fixed contact is key. In the example shown in FIG. 6*a* the contacts 61,62 are in contact at point 64 such that the contacts are closed and a current flows through both contacts and no arcing is present.

Figure 2:
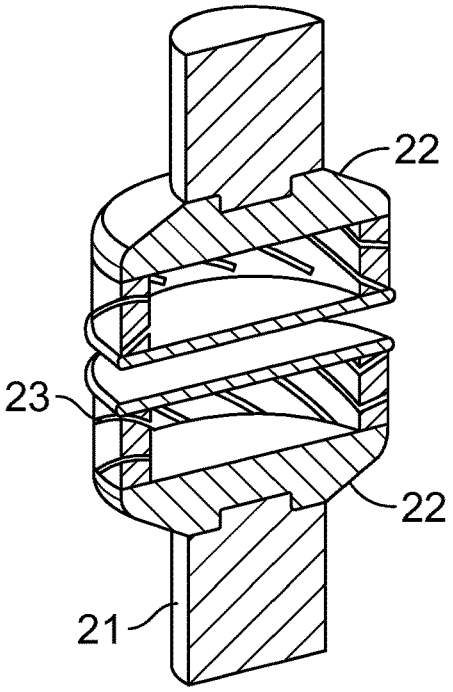
FIG. 2 is an illustration of axial electrical electrodes or contacts suitable for use with the vacuum interrupter of FIG. 1.
Figure 3:
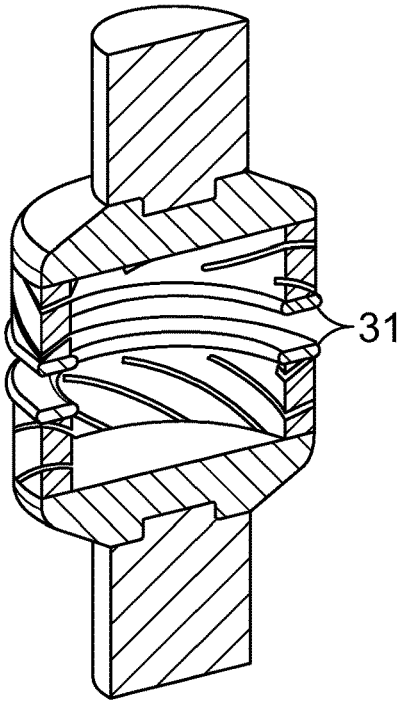
FIG. 3 is an illustration of radial electrical contacts suitable for use with the vacuum interrupter of FIG. 1.

In the event of an overcurrent surge or other switching event, the moveable contact 62 is actuated and moves away from the fixed contact 61. This causes the contact point 64 to be broken and an arc 65 forms between the two contacts. In a conventional vacuum interrupter having circular contacts the arc is directed by techniques as described in FIGS. 1 to 3 above. However, in this embodiment the arc is instead directed away from the contact point 64 and along the contacts 61, 62. This is shown in FIG. 6*c* where the arc 65 has moved along both contacts 61, 62. As the arc 65 moves along the contacts the arc length increases due to the increased separation between the contacts. When the arc reaches the end of the contacts, the arc balloons outwards as shown in FIG. 6*c*, weakening the arc strength. This acts to dissipate the current arc, which may then be quelled or extinguished using dedicated surfaces or baffles placed and designed for such purposes. By separating the arc formation region from the arc quenching region, both regions can be tailored to maximize their functions.

Figure 7:
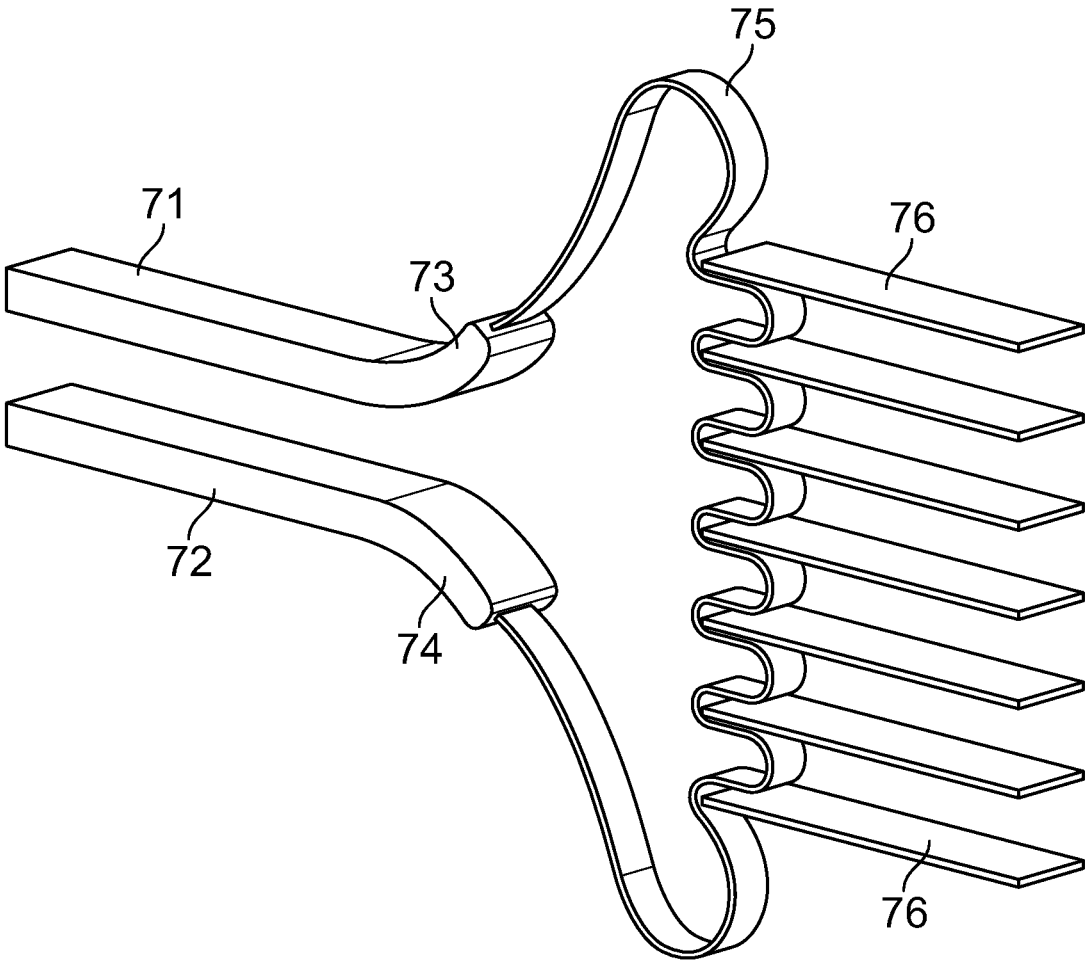
FIG. 7 shows an alternative configuration of the electrical contacts of FIG. 6.

FIG. 7 shows an alternative configuration of the concept explored in FIG. 6. In this embodiment the contacts 71, 72 are connected in a similar manner to described above. However, each contact 71, 72 has a trumpeted shaped end 73, 74. This has the effect that the arc 75 balloons significantly once it reaches the end of the contacts. By spreading and ballooning the arc in this manner the strength of the arc is considerably weakened. Furthermore, in the example shown, arc quenching plates 76 are shown which further extend the arc and divide it, allowing the arc to be quenched by the plates 76.

Figure 8A:
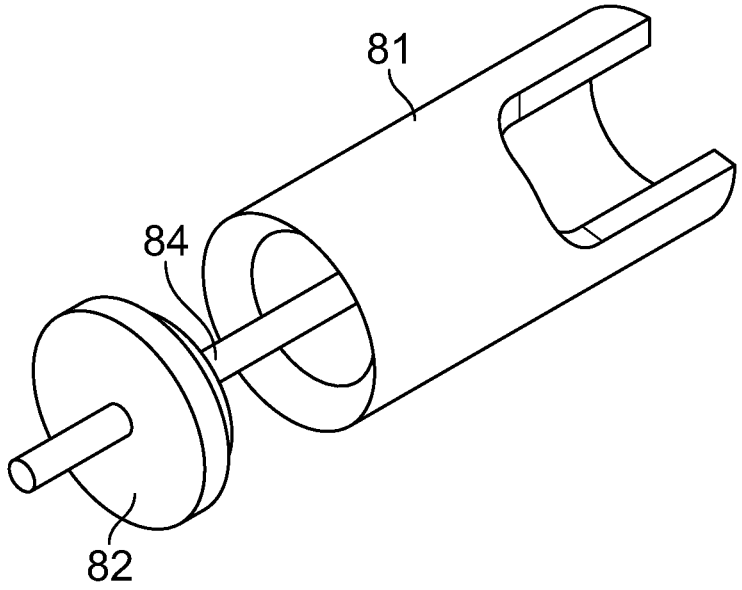
FIGS. 8*a* and 8*b* show a configuration of electrical contacts according to an embodiment and FIGS. 9*a* and 9*b* show an alternative configuration of electrical contacts according to another embodiment.
Figure 8B:
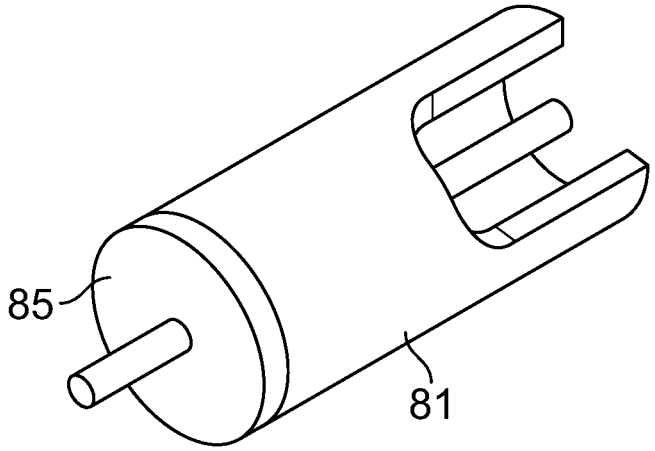

FIG. 8 shows another configuration of the contacts. In this example the fixed contact 81 surrounds or envelops the moveable contact 82. The moveable contact further comprises a rod 84 that runs within the fixed contact 81. FIG. 8*b* shows the contacts in a closed position where moveable contact end plate 85 is in contact within the fixed contact 81. As the moveable contact is separated from the fixed contact during a switching event, the arc travels in a circular path between the rod 84 and the fixed contact 81. In this manner, the arc may be directed away from the contact site in a controlled manner.

Figure 9A:
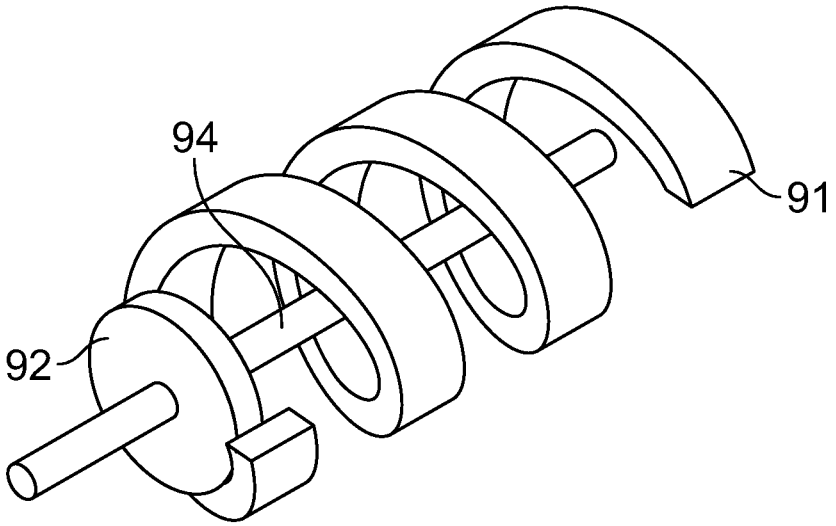
Figure 9B:
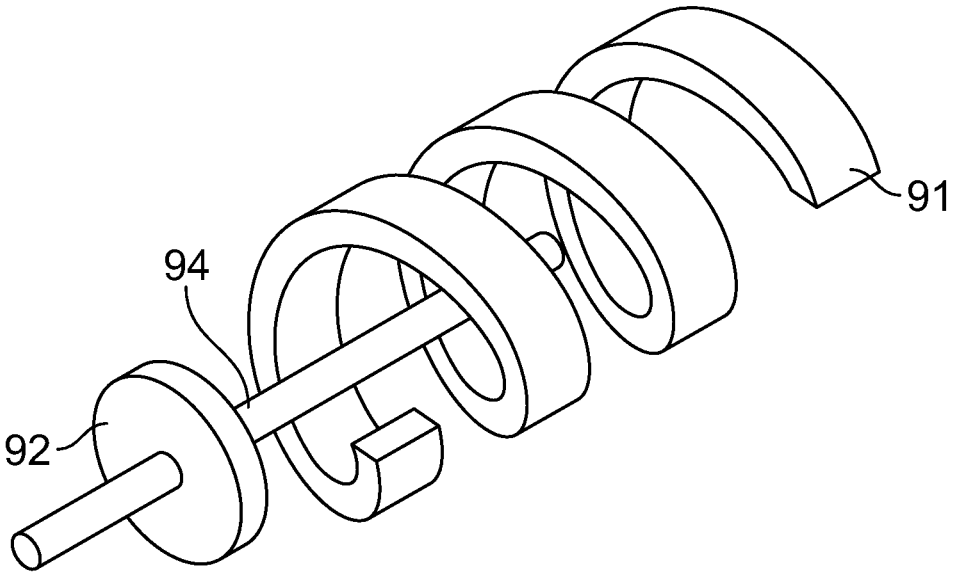

A final example is shown in FIG. 9. This example is similar to FIG. 8, but the fixed contact 91 is a helical shape and spirals around the rod 94 of the moveable contact 92. During arc generation, the arc is formed between the rod 94 and the helical surface of the fixed contact 91 and then travels in a helical manner around the fixed contact.

This concept of transferring or directing an electrical arc away from the point of generation allows both elements to be tailored according to their functionality, rather than being constrained by the other function. Additionally, this concept allows for vacuum switching of DC current due to the arc being directed away from the point of contact rather than continuing to flow as in conventional interrupters. By altering the geometry of the contacts to be non-circular the electrical arc generated is directed away and extended increasing the arc voltage sufficiently to collapse the arc and provide interruption.

The invention claimed is:

1. An electrical interrupter device for switching a short-circuit electrical current in an electric circuit, said device comprising:

a vacuum evacuated housing;

first and second electrodes, configured as first and second rails, respectively, at least partially located within the housing, said first and second electrodes having first and second surfaces, respectfully, being fixed in parallel relationship within the housing to form a fixed elongated contact gap;

a third electrode moveable relative to the first and second electrodes between a closed circuit position and an open circuit position, whereby an electrical arc is generated between the third electrode and at least one of the first and second electrode during said movement;

wherein the arc is directed by the first and second electrodes away from the third electrode via the fixed elongated contact gap and wherein the fixed elongated contact gap has a length such that the arc formed at a first end of the fixed elongated contact gap adjacent the third electrode will experience a current zero or encounter an arc quenching material before reaching a second end of the fixed elongated contact gap.

2. The device according to claim 1, wherein the first and second electrodes are non-circular.

3. The device according to claim 1, further comprising a fourth electrode opposing said third electrode, wherein the third electrode is moveable relative to the fourth electrode and wherein the third and fourth electrodes are in contact in the closed circuit position and are separated by an arc gap in the open circuit position.

4. The device according to claim 3, wherein movement of the third electrode relative to the fourth electrode generates the electrical arc in the arc gap.

5. The device according to claim 4, wherein the arc is transferred from the arc gap to the fixed elongated contact gap when the third electrode moves a distance further away from the fourth electrode than a distance of the fixed elongated contact gap.

6. The device according to claim 1, wherein the first and second electrodes are substantially linear.

7. The device according to claim 1, wherein the first electrode is substantially, spiraled or curved.

8. The device according to claim 1 wherein the first and second electrodes are helically aligned.

9. The device according to claim 1 wherein the arc is directed towards the arc quenching material.

10. The device according to claim 9, wherein the arc quenching material comprises an arc baffle plate target, and wherein the arc is directed to the target for dissipation.

11. The device according to claim 9 wherein the arc quenching material comprises arc splitter plates.

12. The device according to claim 11, wherein the arc splitter plates comprise a plurality of substantially parallel quenching plates, said quenching plates intended to divide the arc into a corresponding plurality of smaller arcs, each smaller arc driven between two quenching plates.

13. The device according to claim 1, wherein the electrodes comprise one or more slots, each slot oriented to produce a magnetic field across the electrodes.

14. The device according to claim 13, wherein the magnetic field acts to drive the arc along the fixed elongated contact gap.

15. The device according to claim 1, wherein the device is a vacuum interrupter.

16. The device according to claim 15, wherein the first, second and third electrodes are wholly located within the housing such that movement of the third electrode to perform a switching function occurs solely within the housing.

17. The device according to claim 1, wherein the electrical current load is a direct current load.

18. The device of claim 1, wherein at least one of the first and second electrodes are non-circular, such that the electrical arc is directed along the non-circular electrode.

* * * * *